US005732846A

United States Patent [19]

Helge

[11] Patent Number: 5,732,846

[45] Date of Patent: Mar. 31, 1998

[54] HOLLOW BODY WITH WATERTIGHT CLOSURE

[76] Inventor: Hans-Heinz Helge, Manaihant 32, B-4800 Petit-Rechain, Belgium

[21] Appl. No.: 608,846

[22] Filed: Feb. 27, 1996

[30] Foreign Application Priority Data

Mar. 13, 1995 [DE] Germany ..... 195 08 953.7

[51] Int. Cl.[6] ..... B65D 51/08; B65D 53/06

[52] U.S. Cl. ..... 220/521; 220/364; 220/265; 220/801

[58] Field of Search ..... 220/522, 521, 220/501, 806, 359, 612, 613, 614, 233, 364, 365, 801; 215/232, 233, 263, 364; 4/498, 499

[56] References Cited

U.S. PATENT DOCUMENTS

| | | | |
|---|---|---|---|
| 790,749 | 5/1905 | Ranney et al. | 215/233 |
| 1,145,472 | 7/1915 | Durand | 220/501 X |
| 2,802,896 | 8/1957 | Tierman et al. | 220/612 X |
| 3,642,163 | 2/1972 | Mcfarland | 220/501 X |

FOREIGN PATENT DOCUMENTS 0225862 5/1986 European Pat. Off. .

*Primary Examiner*—Allan N. Shoap
*Assistant Examiner*—Niki M. Kopsidas
*Attorney, Agent, or Firm*—Collard & Roe, P.C.

[57] ABSTRACT

Hollow body made of metal or plastic with at least two axial chambers with a separation wall therebetween and with a watertight closure including a cap provided with filling and venting openings this cap having stoppers positively insertable in each chamber of the hollow body, with a piston plate filling the cross section of the respective chambers with a hollow spacing being present above these stoppers, and in connection with which the hollow space present between the piston plate and the cap is filled with an elastic permanently filling medium preferably based on plastic, and in the cap, provision is made for at least one overflow duct for the filling medium such duct in each case connecting one chamber with the other chamber by flowing above the top end of the separation wall.

5 Claims, 1 Drawing Sheet

HOLLOW BODY WITH WATERTIGHT CLOSURE

BACKGROUND OF THE INVENTION

1. Field of the Invention

The present invention relates to a hollow body made of metal or plastic, with at least one axial chamber separation wall creating two chambers and with a watertight closure comprising a cap provided with filling openings and venting openings, said cap having stoppers, which are positively insertable in each chamber of the hollow body, with a piston plate filling the cross section of the respective chamber and being mounted on these stoppers, whereby the hollow space present between the piston plate and the cap is filled with an elastic permanently filling medium preferably based on plastic.

2. The Prior Art

In practical situations, it is often a difficult problem to close off hollow bodies made of plastic or light metal in a watertight manner at their ends, in order to make certain that these bodies will always be able to float in water. This water tightness is important not only in the manufacture of water vehicles, but also in regard to roll-type shields for swimming pool covers, which are rolled over on the surface of the water.

The solution to this problem is particularly important in connection with swimming pool covers consisting of extruded transparent or dyed plastic, whereby the underside is dyed dark and the top side is transparent. It is just as important that the top side of such covers is not finished dark at the ends of the profiles, because an accumulation of heat that may be caused by sun radiation may easily lead to material expansions and to a lack of tightness.

Various attempts have been made to provide such hollow bodies with watertight stoppers; however, this did not lead to satisfactory results for technical manufacturing reasons and particularly for thermodynamic reasons.

A closure means of this of the type is known from EP 225,862 A1. In this regard, provision is made for one filling opening and one venting opening for each chamber of the hollow body. Even though this closure has produced good results in practical application, its manufacture and particularly the filling is time-consuming, and thus uneconomical for automation.

SUMMARY OF THE INVENTION

It is an object of the present invention to provide such a hollow body closure means or stopper in a way such that it offers a filling possibility and handling suitable for automatic production equipment.

The above object is achieved according to the present invention by providing a hollow body made of metal or plastic comprising at least two axial chambers having a separation wall therebetween and with a watertight closure means comprising a cap provided with filling opening and venting opening, said cap having stoppers positively insertable into each chamber of the hollow body, said cap having a piston plate filling the cross section of the respective chamber with a hollow space between the piston plate and the cap; said hollow space present between the piston plate and the cap being filled with an elastic permanently filling medium preferably based on plastic, said cap having at least one overflow duct for the filling medium, such duct connecting one chamber with the other chamber and being positioned above the separation wall.

The present invention makes it possible to fill with one filling at least two chambers of the hollow body with a filling medium, whereby a considerable amount of set-up time is saved, which was required in the prior art for inserting the filling nozzle.

The piston plates simply form an inner limitation of chambers into which the filling medium is admitted, and at the same time act as a supporting plane for the filling medium. The filling medium may completely fill the entire chamber formed between the piston plate and the cap, and can flow through the overflow duct from one chamber into the other chamber. This assures good watertightness even with a less accurate stopper manufacture, or whenever there are considerable tolerances between the stopper and the hollow body, as well as whenever there is thermal expansion.

Filling of the filling medium is effected through the filling opening in the cap and in the stopper of the one chamber. The venting opening in the part of the cap associated with the other chamber permits controlling whether the chambers are safely filled. Furthermore, it permits evacuation of the air displaced in the chamber by the filling medium.

BRIEF DESCRIPTION OF THE DRAWINGS

Other objects and features of the present invention will become apparent from the following detailed description considered in connection with the accompanying drawing which discloses one embodiment of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 1:
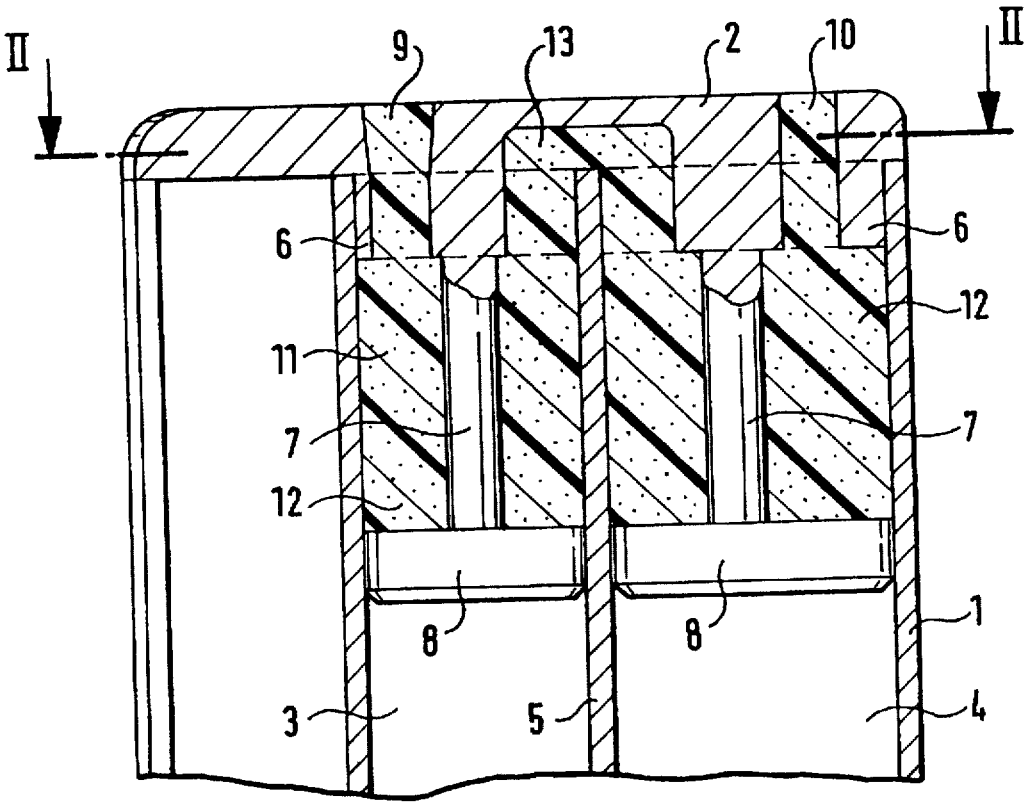
FIG. 1 shows a longitudinal section along line I—I in FIG. 2 through one end of the roll-type structure.
Figure 2:
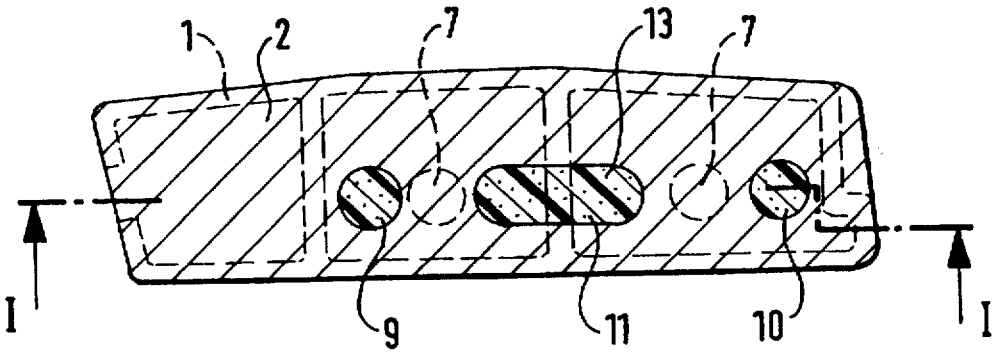
FIG. 2 shows a cross-section view along line II—II in FIG. 1.

Turning now in detail to the drawings, FIGS. 1 and 2 show a hollow body 1 in the form of a part of a roll-type structure with a cap 2. The hollow body profile 1 has the two axial, parallel chambers 3 and 4, which are separated from each other by a separation wall 5. The hollow body 1 can be extruded and may be constructed of plastic or light metal.

The stoppers 6 are a part of the cap, forming a unitary structure with the cap. Each of said stoppers positively projects into the chamber 3 or 4. Each stopper 6 is solidly joined with a thin shaft 7; and the free ends of these shafts each have a piston plate 8 mounted thereon, such plate 8 filling the cross section of the respective chamber 3 or 4. In the cap 2, provision is made in each case for a filling opening 9 above the chamber 3, and for a venting opening 10 above the chamber 4. These openings extend in each case through the stopper 6. Furthermore, in cap 2, an overflow duct or passage 13 extending above and across the top end of the chamber separation wall 5 is located beneath the underside of the cap. This duct 13 permits the filling of at least two chambers 3 and 4 by utilizing only the one filling opening 9. Usefully, the venting opening 10 is present above the chamber 4, which is remote from the filling opening.

With hollow bodies having more than two chambers, it is possible also to make provision for overflow ducts 13 above the chamber separation walls, and to utilize very few filling and venting openings.

The filling opening 9 serves for admitting an elastic permanently filling medium 11 (shown in the drawing by the series of dots) preferably made of plastic material and generally known as a sealing medium such as an adhesive. Once the hollow space 12 between the cap 2 and the piston plates 8 has been filled with the filling medium 11, a watertight closure is obtained. The filling medium supports itself on the piston plates 8 and does not flow into the remaining part of the hollow body 1. It can be seen that the hollow spaces 12 are completely filled when excess filling medium 11 is observed to exit from the venting opening 10. With automatic filling apparatus, a sensor device will then shut off the filling process.

The hollow body 1 can be made of light metal, such as aluminum or magnesium, or made of plastic such as a thermoplastic, for example polyolefin like polyethylene, or a thermosetting resin, for example phenol formaldehyde. The filling medium 11 can be an adhesive such as epoxy resin, or a polyurethane adhesive. Thus, filling medium 11 is elastic and capable of forming a permanent watertight seal between the hollow body 1 and the cap 2.

While one embodiment of the present invention has been shown and described, it is to be understood that many changes and modifications may be made thereunto without departing from the spirit and scope of the invention as defined in the appended claims.

What is claimed is:

1. A hollow body comprising at least two axial chambers comprising one axial chamber and another axial chamber having a separation wall therebetween;

a watertight closure comprising a cap having a filling opening and having a venting opening, said cap having stoppers positively insertable into each axial chamber of the hollow body, said cap having a piston plate filling the cross section of each respective axial chamber with a hollow space between the piston plate and the cap; said hollow space present between the piston plate and the cap being filled with an elastic permanently filling medium;

said cap having at least one overflow passage for the filling medium, such passage connecting said one axial chamber with said another axial chamber and being positioned above the separation wall; said hollow body being made of a material selected from the group consisting of metal and plastic.

2. The hollow body according to claim 1, wherein said two axial chambers are connected; and wherein said two connected chambers combined have only one filling opening and one venting opening in the cap.

3. The hollow body according to claim 1, wherein the filling opening widens conically outwardly.

4. The hollow body according to claim 1, wherein the hollow body is made from a material selected from the group consisting of aluminum, magnesium, thermoplastic and thermosetting resin.

5. The hollow body according to claim 1, wherein the filling medium is made of plastic.

* * * * *